US006002899A

United States Patent [19]

Stover et al.

[11] Patent Number: 6,002,899

[45] Date of Patent: Dec. 14, 1999

[54] IMAGE CONDITIONING/RECHARGE APPARATUS FOR ELECTROSTATIC PRINTING SYSTEMS USING LIQUID DEVELOPMENT

[75] Inventors: Raymond W. Stover, Webster; James E. Williams, Penfield; Gerald M. Fletcher, Pittsford, all of N.Y.

[73] Assignee: Xerox Corporation, Stamford, Conn.

[21] Appl. No.: 09/232,459

[22] Filed: Jan. 19, 1999

[51] Int. Cl.[6] ..... G03G 15/22; G03G 15/02; G03G 15/10

[52] U.S. Cl. ..... 399/148; 399/176; 399/249

[58] Field of Search ..... 399/148, 149, 399/150, 168, 170, 174, 176, 249, 50

[56] References Cited

U.S. PATENT DOCUMENTS 4,286,039 8/1981 Landa et al. .
4,420,244 12/1983 Landa .
4,684,238 8/1987 Till et al. .
4,690,539 9/1987 Radulski et al. .
4,707,112 11/1987 Hartmann .
5,276,492 1/1994 Landa et al. .
5,406,356 4/1995 Campbell et al. ..... 399/127
5,517,289 5/1996 Ito et al. ..... 399/149
5,794,098 8/1998 Folkins ..... 399/50

*Primary Examiner*—William Royer
*Assistant Examiner*—Hoang Ngo
*Attorney, Agent, or Firm*—Oliff & Berridge, PLC

[57] ABSTRACT

A blotter/charging device is provided for simultaneously removing excess liquid carrier from a developed toner image and recharging a photoreceptor in preparation for generating and developing another electrostatic latent image on the photoreceptor. The blotter/charging device is useful for all types of liquid developing systems that generate two or more toner images on a photoreceptor, including image-next-to-image, image-on-image, highlight and other types of systems. A method is also provided for generating a plurality of toner images on a support wherein excess liquid carrier is removed from a developed toner image simultaneous with recharging of the support in preparation for generating and developing a second electrostatic image on the support.

19 Claims, 2 Drawing Sheets

IMAGE CONDITIONING/RECHARGE APPARATUS FOR ELECTROSTATIC PRINTING SYSTEMS USING LIQUID DEVELOPMENT

BACKGROUND OF THE INVENTION

1. Field of Invention

The invention relates to an image conditioning and recharge apparatus and method for liquid developing electrostatic printing systems. In particular, the invention relates to simultaneous image conditioning, i.e., removal of liquid carrier from a developed toner image, and photoreceptor recharge for subsequent exposure and development of a second toner image.

2. Description of Related Art

Electrostatographic printing is well known and commonly used for copying or printing documents on a paper substrate. Electrostatographic printing is performed by forming a substantially uniform charge on a photoconductive member and exposing the photoconductive member to a pattern of light. Exposing the photoconductive member to the pattern of light generates a corresponding electrostatic latent image on the photoconductive member. Toner particles are then deposited onto the photoconductive member so that the toner particles are selectively deposited in either charged or discharged areas on the photoconductive member. The developed toner image is then typically transferred to a substrate and fixed to the substrate by heat and/or pressure. The photoreceptor is then cleaned of any residual toner or electric charge in preparation for another charge/electrostatic latent image generating/development process.

Electrostatographic printing systems typically develop an electrostatic latent image using solid toner particles either in powder form or suspended in a liquid carrier. In liquid developing systems, the liquid developer typically has about two percent by weight toner material distributed in the liquid carrier. An electrostatic latent image is developed by applying the liquid developer to the photoconductive member, whereby the toner particles are selectively attracted to the surface of the photoconductive member in accordance with an electrostatic latent image. Typically, the toner image on the photoconductive member immediately after development contains about 12% by weight particulate toner. To improve the quality of a final image transferred to a substrate such as paper, excess liquid carrier should be removed from the developed image.

A method for removing excess liquid carrier from a developed toner image is described in U.S. Pat. No. 4,684,238 to Till et al., U.S. Pat. No. 4,420,244 to Landa, U.S. Pat. No. 5,028,964 to Landa et al., and U.S. Pat. No. 5,276,492 to Landa et al., in which an electrically-charged roller is positioned near and/or against a moving photoconductive surface having a developed toner image. As the developed toner image passes by the roller, excess liquid carrier is removed. The roller is charged to repel toner particles in the developed image so that toner particles are not removed along with the excess liquid carrier. In some cases, the roller is also said to have some affect on the charge on the photoconductive drum and/or the developed toner image.

Some liquid developing systems perform an image-on-image (IOI) process. In an IOI process, layers of toner are built up on a photoreceptor to create a process color image. Therefore, in an IOI process, after a first toner layer is formed on the photoreceptor, the photoreceptor typically must be recharged and exposed before a next toner layer can be deposited on the photoreceptor. One process for recharging a photoreceptor is a "split recharge" process, in which a first charging device overcharges the photoreceptor and a second charging device applies a charge of opposite polarity to the photoreceptor to reduce the level of charge on the photoreceptor. A split recharge system is described in U.S. Pat. No. 5,600,430 to Folkins et al., although the described system is used in a powder developing system. As described in U.S. Pat. No. 5,600,430, a first charging device, such as a corona charging device overcharges the photoreceptor to a level higher than a desired voltage level for exposure. A second charging device, such as a corona charging device, applies a charge of opposite potential to the photoreceptor to reduce the charge level on the photoreceptor to a desired pre-exposure level.

SUMMARY OF THE INVENTION

The invention provides an image conditioning and recharge device for a liquid developing printing system that simultaneously removes excess liquid carrier from a developed toner image and recharges a photoreceptor in preparation for generating a subsequent electrostatic latent image on the photoreceptor.

In one aspect of the invention, the image conditioning/recharge device operates as a first stage in a split recharge process.

The invention also provides a method for recharging a photoreceptor having at least one developed toner image wherein excess liquid carrier in the developed toner image is removed simultaneous with recharge of the photoreceptor in preparation for generating a subsequent electrostatic latent image on the photoreceptor.

In one aspect of the invention, simultaneous removal of excess liquid carrier and recharge of the photoreceptor is followed by applying a charge opposite in polarity to a charge applied to the photoreceptor during excess liquid carrier removal.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

Figure 1:
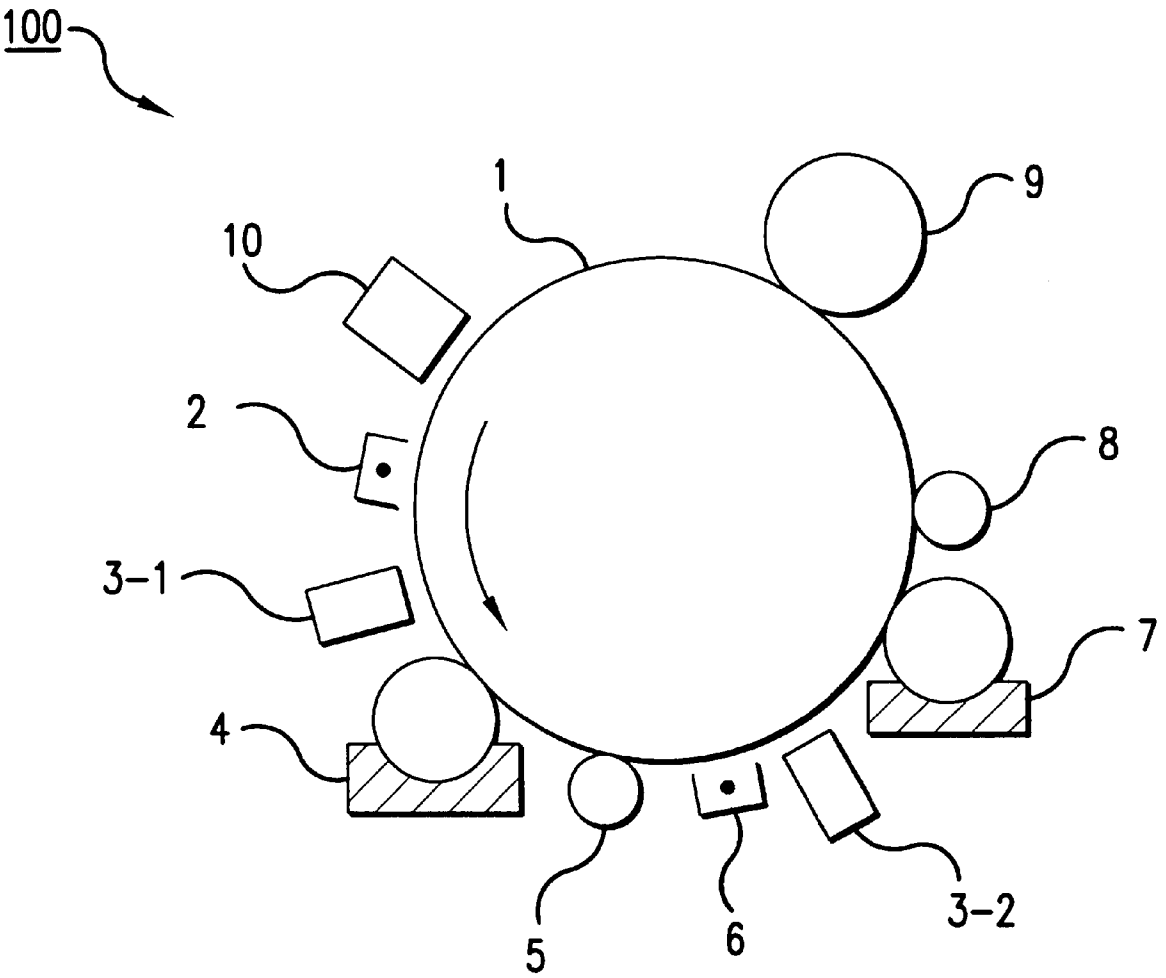
FIG. 1 is a schematic block diagram of an embodiment of a liquid development printing system in accordance with the invention.

FIG. 1 is a schematic block diagram of a liquid developing printing apparatus 100 in accordance with the invention. The liquid developing printing apparatus 100 is only one example of the different kinds of liquid developing systems in which the invention can be used. For example, the liquid developing printing apparatus 100 includes multiple exposure devices that each form an electrostatic latent image on the photoreceptor. However, as is well known, the apparatus 100 could be modified to use only one exposure device. In addition, the apparatus 100 includes two developers, but three or more developers could be used, if desired.

The printing apparatus 100 includes a photoreceptor 1 that rotates in a counterclockwise direction. In this embodiment, the photoreceptor 1 is a solid drum, but can be formed as a flexible or inflexible belt, as is known in the art. Generally, the photoreceptor 1 includes a photoconductive material formed on a conductive substrate (not shown). The conductive substrate is typically grounded so that when a charge is distributed on the photoconductive surface and a portion of the photoreceptor 1 surface is illuminated, charge on the photoconductive surface is drained through the illuminated portion to the conductive substrate.

The photoreceptor 1 is charged by a charging device 2, which can be an AC or DC corotron, scorotron, dicoroton, pin scorotron or other charging device known in the art. The charging device 2 distributes a substantially uniform charge of either negative or positive polarity on the photoreceptor I surface. An exposure device 3-1 exposes the charged photoreceptor 1 surface to a desired pattern of light. Exposed portions of the photoreceptor 1 are discharged to form an electrostatic latent image on the photoreceptor 1. The exposure device 3 can include any known exposure devices, including an addressable laser, ROS device, a moving lens system that projects an image of a scanned document onto the photoreceptor 1, etc.

A first developer 4 applies liquid developer containing toner particles to the photoreceptor 1 surface so that toner particles are selectively deposited on the photoreceptor 1 in accordance with the electrostatic latent image formed by the exposure device 3. Either charged area development (CAD) or discharged area development (DAD) can be performed as desired. In charged area development, toner particles are deposited in charged areas of the photoreceptor 1. In discharged area development, toner particles are deposited on discharged areas of the photoreceptor 1. For example, if DAD is performed using a negatively charged photoreceptor 1, negatively charged toner particles in the liquid developer are deposited in discharged areas and repelled from charged areas on the photoreceptor 1. The developers 4 and 7 are shown only schematically in FIG. 1. Any known device for developing a latent image can be used, such as immersing the photoreceptor 1 in liquid developer, or applying liquid developer to the photoreceptor 1 using a roller, etc.

After the toner image is developed on the photoreceptor 1, excess liquid carrier on the photoreceptor 1 is removed by a blotter/recharge device 5. That is, the blotter/recharge device 5 serves to both remove excess liquid carrier from the developed image and charge the photoreceptor 1 to a desired level. In a preferred embodiment, a second stage recharge device 6 applies a charge opposite in polarity to the charge applied by the blotter/recharge device 5 to decrease the charge level on the photoreceptor 1. However, the second stage recharge device 6 is optional. If the second stage recharge device 6 is not used, the blotter/recharge device 5 charges the photoreceptor 1 to a desired level before a second electrostatic latent image is formed on the photoreceptor 1, e.g. the blotter/recharge device 5 charges the photoreceptor 1 to a level similar to that performed by the charging device 2.

For example, if split recharge is used and the charging device 2 charges the photoreceptor 1 to a level of −500 volts, the blotter/recharge device 5 may charge the photoreceptor 1 to a level of −700 volts. Then, a second stage recharge device 6 applies a positive charge to the photoreceptor 1 to adjust the charge level on the photoreceptor 1 to approximately −500 volts. If the second stage recharge device 6 is not used, the blotter/recharge device 5 charges the photoreceptor 1 to a level of approximately −500 volts. As discussed above, depending on the type of photoreceptor 1 used in the printing apparatus 100, the photoreceptor 1 can be positively charged. The level to which the photoreceptor 1 is charged depends upon various factors, including the type of photoreceptor 1, the type of and charge on toner particles in the toner image, the thickness and number of toner layers applied to the photoreceptor 1, and other factors.

Once the photoreceptor 1 is recharged, an exposure device 3-2 illuminates selected portions of the photoreceptor 1 to generate a second electrostatic latent image. The second electrostatic latent image is developed by a second developer 7, which operates similarly to the first developer 4. A blotter 8 removes excess liquid carrier from the developed toner image and adjusts the charge on the developed toner image and/or the photoreceptor 1 in preparation for transferring the toner image from the photoreceptor 1. However, the blotter 8 need not adjust the charge on the toner layer on the photoreceptor 1, if desired. An image transfer device 9 transfers the developed toner image to a substrate, such as a paper substrate or to some other surface, such as an image bearing roller or belt.

A cleaning device 10 removes any residual toner and/or charge on the photoreceptor 1 after the developed toner image is transferred by the image transfer device 9. The cleaning device 10 can include any of several different devices as is known in the art, such as a cleaning blade, roller, or other device for removing residual toner, and a lamp or other device for removing residual electric charge on the photoreceptor 1.

Figure 2:
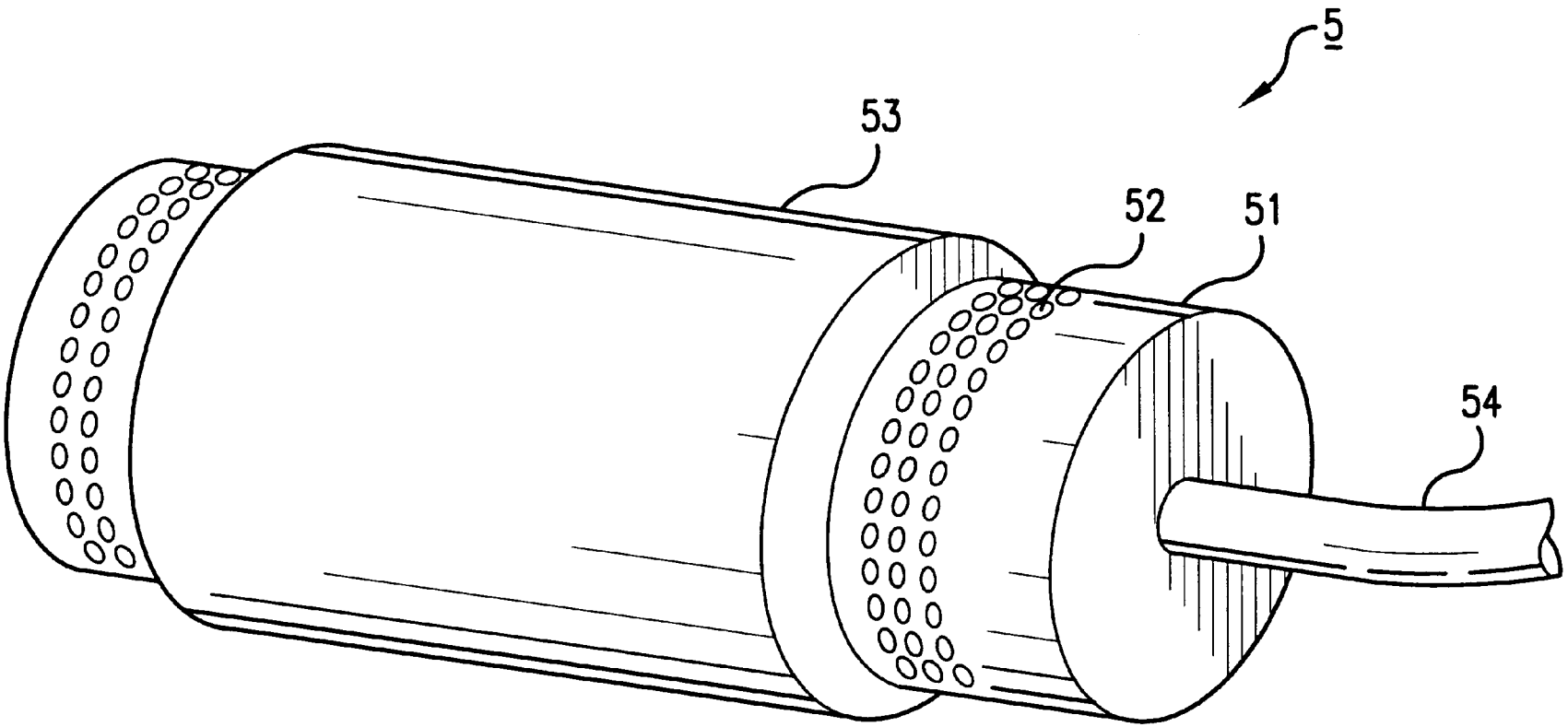
FIG. 2 is a schematic diagram of a blotter/recharge device in accordance with the invention.

FIG. 2 is a schematic diagram of a blotter/recharge device in accordance with the invention. The blotter/recharge device 5 includes a porous, conductive rubber layer 53 formed on a cylindrical conductive core roll 51. The conductive rubber layer 53 can be carbon loaded to provide a desired level of conductivity for the rubber layer 53. The conductive core roll 51 can be made of any suitable conductive material, such as aluminum. The conductive core roll 51 is electrically connected to a voltage source (not shown) so that an electrical potential/current can applied to the roll 51 and the rubber layer 53. The conductive core roll 51 has a plurality of perforations 52 that communicate with a channel (not shown) formed inside of the roll 51 that communicates with a vacuum hose 54. Therefore, when relative negative pressure, i.e., a vacuum, is applied to the vacuum hose 54, liquid carrier on the surface of the conductive rubber layer 53 is sucked through the rubber layer 53 and the perforations 51 and is removed through the vacuum hose 54.

The blotter/recharge device 5 is preferably positioned in contact with the photoreceptor 1 so that the rubber layer 53 deforms slightly. The blotter/recharge device 5 also preferably rotates in a direction opposite the photoreceptor 1 so that excess liquid carrier can be removed, but toner particles are not removed. For example, if the photoreceptor 1 rotates in a counterclockwise direction as shown in FIG. 1, the blotter/recharge device 5 preferably rotates in a clockwise direction. However, the blotter/recharge device 5 could rotate in the same direction as the photoreceptor 1, if desired.

In operation, the blotter/recharge device 5 contacts the photoreceptor 1 surface having a developed toner image and excess liquid carrier is absorbed by the rubber layer 53 and removed through the vacuum hose 54. Simultaneously, a DC signal is preferably applied to the conductive core roll 51 so that a charge is applied to the photoreceptor 1 and/or the toner image.

Other types of blotter/recharge devices can be used instead of the specific embodiment shown in FIG. 2. For example, the blotter/recharge device 5 could be a cylindrical conductive member, e.g., an aluminum cylinder, that is spaced from the photoreceptor 1 and rotates in the same direction as the photoreceptor 1. Excess liquid carrier is removed by hydrodynamic forces created between the blotter/recharge device 5 and the photoreceptor 1, and the excess liquid carrier is removed from the blotter/recharge device 5. The excess liquid carrier is removed either by vacuum through perforations in the blotter/recharge device 5 or by being removed from the surface of the blotter/recharge device 5 by a doctor blade or other suitable device. Charge is transferred from the blotter/recharge device 5 through the liquid developer to the photoreceptor 1.

As discussed above, the invention is useful in both DAD and CAD processes. In DAD processes, the blotter/recharge device 5 charges the photoreceptor 1 using the same polarity charge as that on the toner particles. In CAD systems, the blotter/recharge device 5 charges the photoreceptor 1 using a polarity opposite the charge polarity on the toner particles. Thus, there is a risk that the toner particles are attracted to the blotter/recharge device 5 and removed from the photoreceptor 1. Accordingly, the deposited toner layers must be maintained with an opposite charge polarity than they had during development so that the charging by the blotter/recharge device has the correct polarity for the photoreceptor 1.

Although the above embodiment is described in connection with an IOI system, the invention can be used in systems that use highlight color or image-next-to-image (INI) processes or other processes. In short, the invention is useful for simultaneously removing excess liquid carrier and charging a photoreceptor for subsequent electrostatic latent image generation and development in any type of electrostatographic printing apparatus using liquid development.

While the invention has been described with specific embodiments, the description of the specific embodiments is illustrative only and is not to be construed as limiting the scope of the invention. Various other modifications and changes may occur to those skilled in the art without departing from the spirit and scope of the invention.

What is claimed is:

1. A printing device comprising:

a photoreceptor having a first electrostatic latent image formed on a surface of the photoreceptor;

a developer that develops the first electrostatic latent image using a liquid developing medium; and a blotter/charging device that simultaneously removes excess liquid from a developed toner image corresponding to the first electrostatic latent image and charges the photoreceptor in preparation for generating a second electrostatic latent image on the photoreceptor.

2. The printing device of claim 1, further comprising:

a second charging device that applies a charge to the photoreceptor that is opposite in polarity to a charge applied by the blotter/charging device to adjust a charge on the photoreceptor to a desired level.

3. The printing device of claim 1, wherein toner particles in the liquid developing medium are deposited in charged areas of the first electrostatic latent image.

4. The printing device of claim 1, wherein toner particles in the liquid developing medium are deposited in discharged areas of the first electrostatic latent image.

5. The printing device of claim 1, wherein the blotter/charging device has a substantially cylindrical shape and has an outer surface nearest the photoreceptor that moves in a same direction as the photoreceptor.

6. The printing device of claim 1, wherein the blotter/charging device has a substantially cylindrical shape and has a surface nearest the photoreceptor that moves in a direction opposite the photoreceptor.

7. The printing device of claim 1, wherein the blotter/charging device comprises:

a cylindrical, perforated conductive core roll; and a conductive rubber layer formed around a portion of the core roll.

8. The printing device of claim 1, wherein a DC signal is applied to the blotter/charging device to charge the photoreceptor.

9. A method of forming a plurality of toner images on a support, comprising:

forming an electrostatic latent image on the support;

developing the electrostatic latent image using a liquid developing medium; and simultaneously removing excess liquid carrier from a developed toner layer on the support and charging the support to a desired level in preparation for forming another electrostatic latent image on the support.

10. The method of claim 9, further comprising:

applying a charge opposite in polarity to a charge applied while simultaneously removing excess liquid carrier.

11. The method of claim 9, wherein the step of developing the electrostatic latent image comprises depositing toner particles in charged areas of the electrostatic latent image.

12. The method of claim 9, wherein the step of developing the electrostatic latent image comprises depositing toner particles in discharged areas of the electrostatic latent image.

13. The method of claim 9, wherein the step of simultaneously removing excess liquid carrier and charging the support comprises moving a blotting/charging surface in a same direction as the support.

14. The method of claim 9, wherein the step of simultaneously removing excess liquid carrier and charging the support comprises moving a blotting/charging surface in a direction opposite the support.

15. The method of claim 9, wherein the step of removing excess liquid carrier and charging the support comprises applying a DC signal to a blotter/charging device.

16. A printing device comprising:

electrostatic image forming means for forming an electrostatic latent image on a support;

developing means for developing the electrostatic latent image on the support using a liquid developer; and blotter/charging means for simultaneously removing excess liquid carrier from a developed toner image on the support and charging the support in preparation for generating another electrostatic latent image on the support.

17. The printing device of claim 16, further comprising charging means for applying a charge of opposite polarity to a charge applied by the blotter/charging means.

18. The printing device of claim 17, wherein the charging means comprises a corona charging device.

19. The printing device of claim 16, wherein the blotter/charging means comprises:

a cylindrical, perforated conductive core roll; and a conductive rubber layer formed around a portion of the core roll.

* * * * *